United States Patent [19]

Folsom

[11] 4,027,475

[45] June 7, 1977

[54] POWER SYSTEMS

[75] Inventor: Lawrence R. Folsom, Charlotte, Vt.

[73] Assignee: Advanced Power Systems, North Haven, Conn.

[22] Filed: May 24, 1976

[21] Appl. No.: 689,460

Related U.S. Application Data

[60] Continuation of Ser. No. 518,633, Oct. 29, 1974, abandoned, which is a division of Ser. No. 371,742, June 20, 1973, abandoned.

[52] U.S. Cl. ..... 60/39.61; 60/369; 91/339; 417/481

[51] Int. Cl.[2] ..... F02G 3/00

[58] Field of Search ..... 91/223, 303, 315, 339, 91/340, 341 R, 345, 349, 350, 352, 354, 375 R; 92/120, 121, 122; 60/369, 376, 387, 477, 484, 39.61; 417/481

[56] References Cited

UNITED STATES PATENTS

| | | | |
|---|---|---|---|
| 552,798 | 1/1896 | Trucks | 91/340 |
| 771,393 | 10/1904 | Reynolds | 91/345 X |
| 2,402,742 | 6/1946 | Ellis | 60/403 X |
| 2,706,969 | 4/1955 | Bannister et al. | 91/340 X |
| 3,596,563 | 8/1971 | Buck | 91/339 X |

*Primary Examiner*—Edgar W. Geoghegan
*Attorney, Agent, or Firm*—DeLio and Montgomery

[57] ABSTRACT

The disclosure describes a drive system including an engine with a rotor which has oscillatory motion. The engine may be of either an internal or external combustion type. The drive system further includes a conversion device coupled to the engine rotor and adapted to convert the oscillatory motion of the engine rotor to unidirectional energy. The power output of the system may be controlled by controlling the speed and length of stroke of the engine.

26 Claims, 42 Drawing Figures

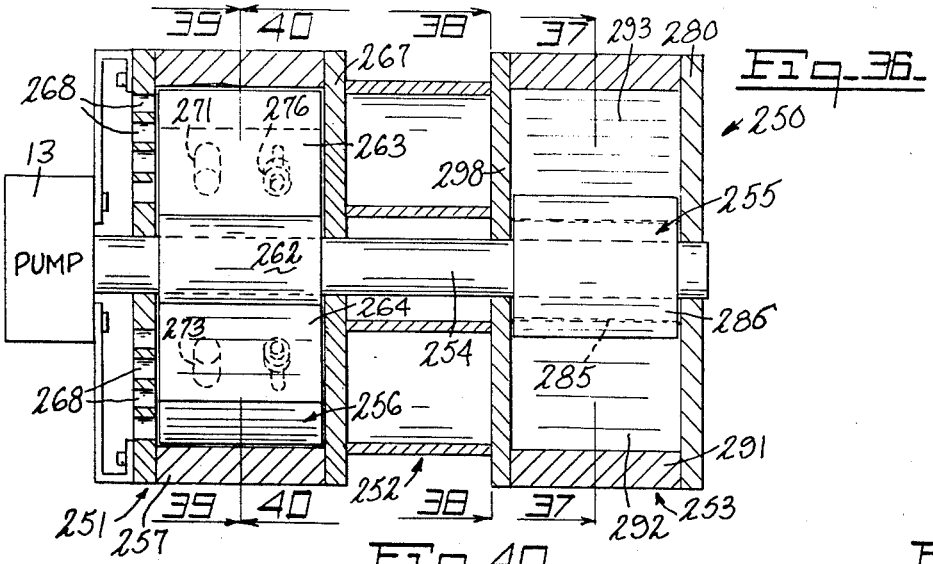
Fig. 36.
Fig. 40.
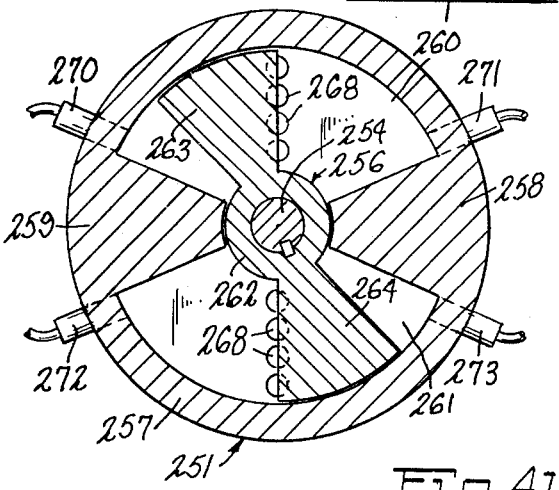
Fig. 37.
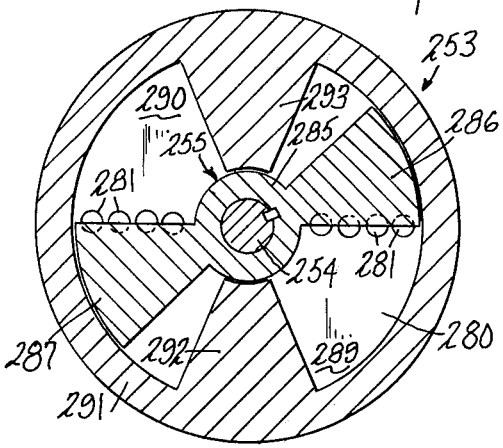
Fig. 41.
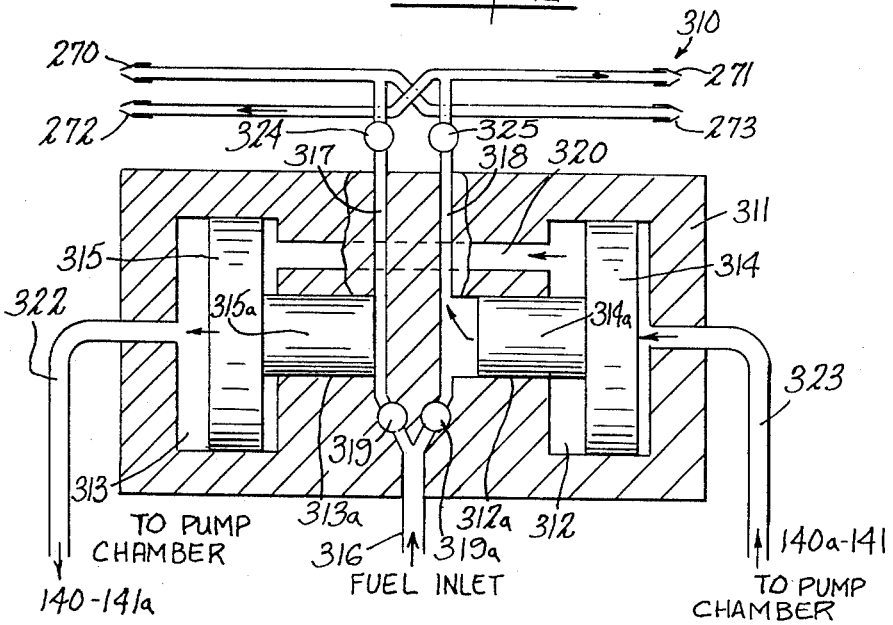

POWER SYSTEMS

This is a continuation of application Ser. No. 518,633, filed Oct. 29, 1974; now abandoned application Ser. No. 518,633 is a division of 371,742, filed June 20, 1973, now abandoned.

This invention relates to power systems and more particularly relates to power systems which may use an oscillating rotor engine of either the internal or external combustion type.

The prior art discloses many different types of engines for turning a drive shaft; for example, steam, turbine and internal combustion. Each of such engines has its own peculiar advantages and disadvantages. The primary disadvantage of most common engines for automotive use of the internal combustion type is the necessity to control the exhaust emissions. The present emission control devices for internal combustion engines cause such engines to have very poor overall efficiency while consuming substantially more fuel. Additionally, the reciprocating piston type engine is relatively large for its power output.

The present invention provides a new and improved drive system and engine therefor of the type which includes an oscillating rotor. In this connection, the term "oscillating" refers to back and forth motion of the rotor about a longitudinal axis. Oscillating rotor engines of the internal combustion type are shown in U.S. Pat. Nos. 829,231; 1,042,322; and 1,069,936, among others. Engines of the external combustion type using this rotor motion are also described in U.S. Pat. No. 829,231.

All of these types of oscillating rotor engines require a crank shaft converter to change the oscillatory motion to rotary. The requirement for this crank converter places certain limitations on the performance of the engine. The crank limits the rotor motion, thus limiting the compression ratio, and the valve timing is fixed. These limitations result in less efficiency and decreased power output, and lack of good speed control, as well as the necessity of the cumbersome crank converter.

The present invention provides a drive system using an engine of the type described in which the output of the oscillating shaft is converted to a more useful form without the necessity of a crank converter. An engine embodying the invention has an extremely high torque and horsepower output on a weight and volume ratio basis as compared to reciprocating piston type engines. An internal combustion engine embodying the invention will provide approximately twice the average torque and over three times the peak torque of a conventional piston engine with the same equivalent stroke, effective pressure working area, and same mass of fuel.

An engine embodying the invention may have variable compression ratios of thirty to one or higher, and have full torque response on only the second power stroke. An engine embodying the invention requires only one moving part as an internal combustion engine and only two moving parts as an external combustion engine.

Briefly stated, the invention in one form thereof comprises an engine having a generally cylindrical housing with diametrical stator projections which divide the interior of the housing into two chambers. A rotor having radially extending vanes on either side thereof is rotatably mounted within the housing. As the rotor oscillates the vanes move in the two chambers between the projections. In one end wall of the housing are provided inlet openings, two for each chamber spaced at the ends of the chambers adjacent the stator projections. A valve member which is rotatable with respect to the rotor shaft is movable to cover and uncover diagonally opposite openings to admit fluid under pressure alternately to the rotor on opposite sides thereof, and a valve control member mounted to the rotor shaft actuates said valve member at the end of each stroke to reverse the rotor by admitting fluid under pressure in front of the rotor. The housing further defines an exhaust port from each chamber that is uncovered by the rotor as it approaches the end of its power stroke. The speed and torque of the rotor are controlled by controlling the volume of fluid pressure admitted into the openings during each stroke. Directly coupled to the rotor may be an energy conversion device in the form of a hydraulic pump having a pump rotor which operates on the basic motion imparted thereto by the engine rotor. The pump is arranged to draw hydraulic fluid from a reservoir and supply it under pressure during each stroke of the engine. The fluid pressure output of the shaft may be utilized to drive one or more hydraulic motors which may turn a drive shaft or power the driving axles of a vehicle.

In another form of the invention where the engine is of the internal combustion type, one of the chambers is utilized as a combustion chamber and the other chamber is utilized as a supercharging chamber. In this embodiment either the spark plugs, or fuel injection nozzles, if of the diesel type, are positioned near the extremities of the combustion chamber and the rotor is so formed that during one stroke a fuel air mixture is taken into an inlet in the supercharging chamber, compressed and utilized to charge and purge one side of the combustion chamber. Then when the rotor reverses, such gas is subjected to an extremely high degree of compression as the combustion rotor vane moves toward a spark plug or injection nozzle.

In another form of the invention an engine operating as an internal combustion engine utilizes four spark plugs or injection nozzles each being positioned at an extremity of a chamber, and a compressor or supercharger is driven by the rotor shaft.

The invention further provides new and improved rotor and stator seals for an oscillating engine of the type described.

An object of this invention is to provide a new and improved drive system.

Another object of this invention is to provide a drive system wherein the output of an engine of the oscillating rotor type is converted directly into usable energy without the necessity of providing a crank converter.

Another object of this invention is to provide an oscillating rotor engine of the type described in which there are no external limitations on the speed control or stroke of the rotor.

Another object of this invention is to provide an oscillating engine of the external combustion type having new and improved intake valving means.

Another object of this invention is to provide new and improved internal combustion engines of the oscillating rotor type.

A further object of this invention is to provide a new and improved construction including rotor and stator sealing means for an engine of the oscillating rotor type.

The features of the invention which are believed to be novel are particularly pointed out and distinctly claimed in the concluding portion of this specification. The invention, however, both as to organization and operation together with further objects and advantages thereof may best be appreciated by reference to the following detailed description taken in conjunction with the drawings, wherein:

FIG. 36 is a longitudinal half-section view of an internal combustion engine embodying the invention and including a supercharger;

FIG. 37 is a view seen in the plane of lines 37—37 of FIG. 36;

FIG. 40 is a view seen in the plane of lines 40—40 of FIG. 36;

FIG. 41 is a view in section showing a fuel injection system for the engine of FIG. 36.

Figures 1, 2:
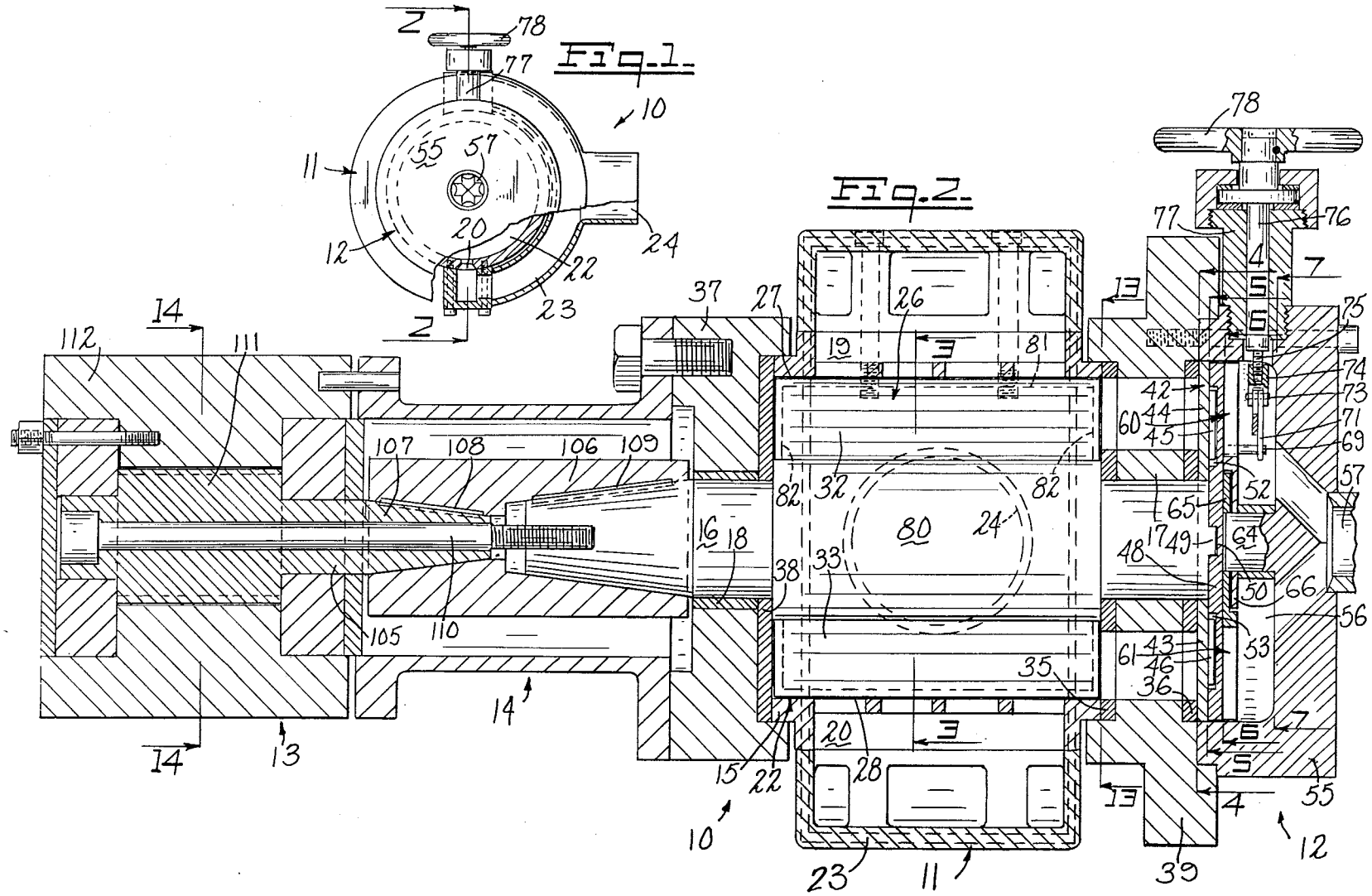
FIG. 1 is a front elevation view of a motive power system embodying the invention.
FIG. 2 is a longitudinal half-section view of the device of FIG. 1 in the plane of lines 2—2 of FIG. 1.

The invention may be embodied in a motive power system 10 which includes an oscillating rotor engine 11 of the external combustion type which drives a hydraulic fluid pump 13 through a coupling 14. Engine 11 includes an inlet valving assembly 12 adapted to control admission of fluid energy to the engine.

Figure 3:
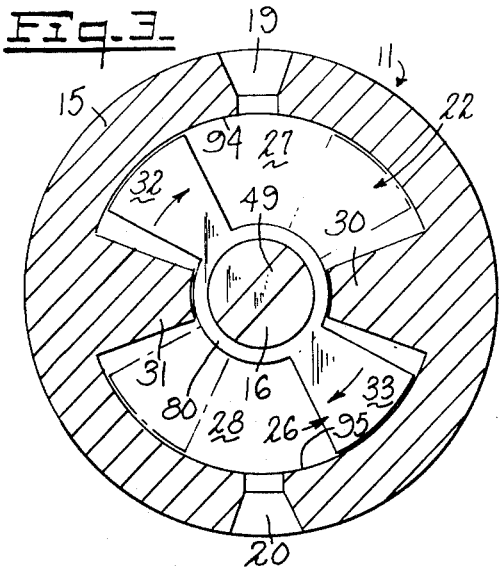
FIG. 3 is a sectional view through the engine of FIG. 2 seen in the plane of lines 3—3 of FIG. 2.

The engine 11, as shown in FIGS. 2 and 3, comprises a housing member 15 having a shaft 16 supported therein on a front bearing 17 and a rear bearing 18.

As shown in FIG. 3, exhaust ports 19 and 20 are defined through housing 15 from a rotor cavity 22 to an exhaust manifold 23 (FIG. 2) surrounding housing 15. Manifold 23 communicates with an exhaust line 24 (FIG. 1).

A rotor 26 is mounted to shaft 16 and moves therewith in an oscillating or reversing rotary motion. The rotor cavity 22 is divided into two sections or chambers 27 and 28 by stator projections 30 and 31 of housing 15 extending into cavity 22. The rotor 26 has two vane-like members 32 and 33 extending diametrically therefrom into chambers 27 and 28, respectively.

As hereinafter more fully explained, the inner peripheral surface of housing 15 is cylindrical, and the stator projections are affixed thereto at diametrically opposite positions. As shown in FIG. 3, the edges of stator projections 30 and 31 and the edges of vanes 32 and 33 are defined on radii from the central axis of housing 15. The projections may be separately formed or integral with the housing.

As hereinafter more fully described the rotor vanes upon oscillatory motion of the rotor will be driven between the stators 30 and 31 by an external source of fluid pressure, and the energy applied to the chambers 27 and 28, and rotor 26 is controlled by the valving arrangement 12.

Figure 4:
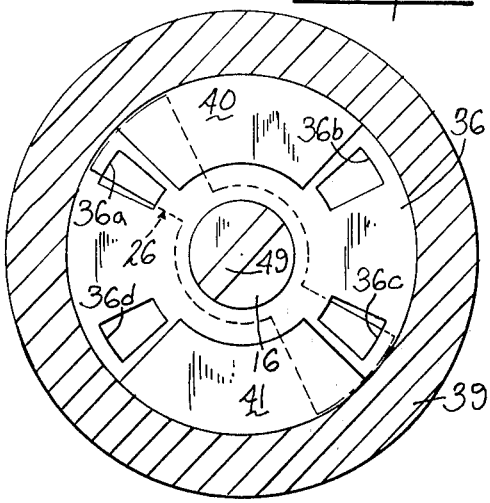
FIG. 4 is a sectional view of the engine of FIG. 2 seen in the plane of lines 4—4 of FIG. 2.
Figure 5:
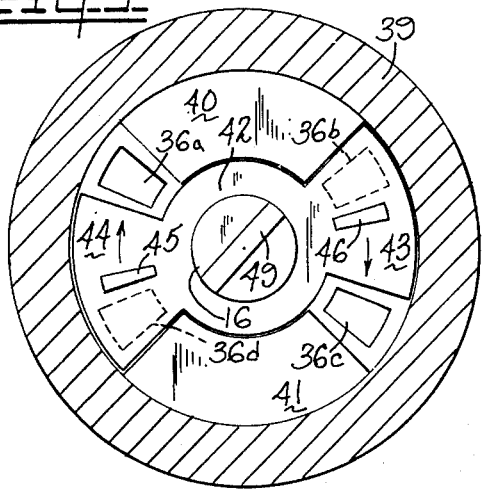
FIG. 5 is a sectional view of the engine of FIG. 2 seen in the plane of lines 5—5 of FIG. 2.

The valving arrangement includes stationary valve plates 35 and 36 spaced apart as shown in FIG. 2, and having openings therein as shown at **36*a* – 36*d* in FIG. 4. The openings in each plate are aligned and shown slightly angularly shifted in FIG. 2. The openings 36*a* and 36*b* provide communication to upper chamber 27 between the stator projections 30 and 31 while the lower inlets 36*c* and 36*d* provide inlets to chamber 28 between the stator projections. These openings into the chambers are positioned near the end of the rotor stroke. The chambers are enclosed at the shaft output end by an end cover member 37 and a seal 38. The other end is enclosed by plate 35, held in place by front cover member 39. Cover member 39 has passages defined therein between the openings in plates 35 and 36. Plate 36 further has upper and lower chordal projections 40 and 41 on the front surface thereof which define the limits of motion of an oscillating valve member 42 (FIG. 5) which is mounted about shaft 16 and which may move relative thereto. Valve member 42 has wing portions 43 and 44, each having a raised projection or lug 45 and 46 disposed thereon intermediate the sides of wings 43 and 44. Valve member 42 rotates on shaft 16 to alternately close inlet openings 36***a* and 36*c* while opening 36*b* and 36*d*, and vice versa.

Figure 6:
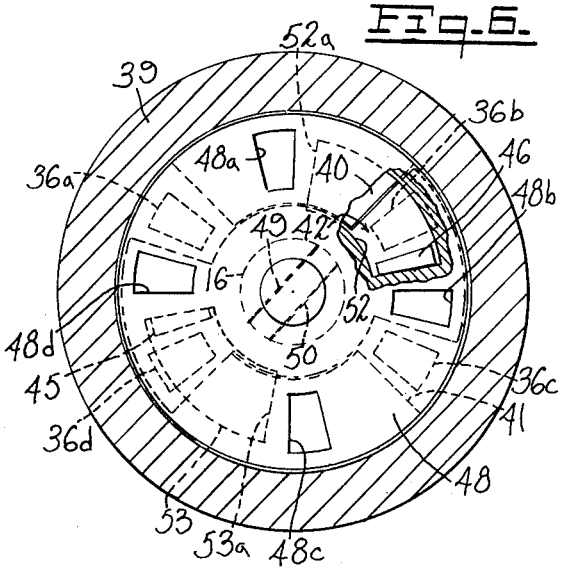
FIG. 6 is a sectional view of the engine of FIG. 2 seen in the plane of lines 6—6 of FIG. 2.
Figure 8:
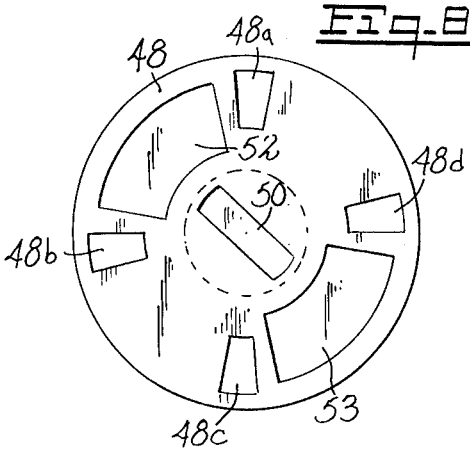
FIG. 8 is a back view of the valve plate which is shown in FIG. 6.

Valving member 42 moves to alternately admit the fluid energy to the rotor chambers 27 and 28 and is driven by the rotor shaft through a lost motion and timing connection formed by a valve control member 48 mounted for rotation with shaft 16. Shaft 16 has a diametrical projection or key 49 on the end thereof which is received in a slot 50 in the back of member 48 (FIG. 8). Member 48 is shown in front view in FIG. 6 and FIG. 8 is a back view thereof. Member 48 has inlet openings 48*a*, 48*b*, 48*c* and 48*d* therein. Member 48, which moves with shaft 16, further has chordal grooves 52 and 53 defined in the back surface thereof to receive the projections 45 and 46. Thus as member 48 moves with shaft 16 towards the end of each stroke, the edges of grooves 52 and 53 will engage projections 45 and 46 and shift the position of valving member 42 to close one pair of the inlet openings and uncover the other pair. At this time, the openings 48*a* – 48*d* are in longitudinal registry with the openings 36*a* – 36*d*. A cover member 55 defines a steam chest 56 and has a port 57 for admission of steam under pressure thereto from a steam generator, not shown.

Figure 7:
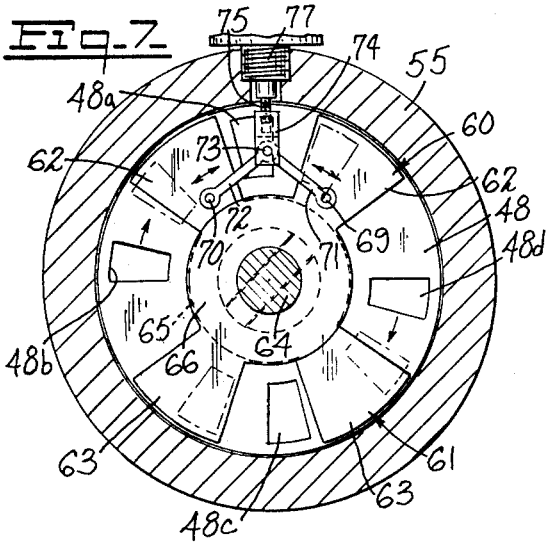
FIG. 7 is a sectional view of the engine of FIG. 2 seen in the plane of lines 7—7 of FIG. 2.

The output of the engine is controlled by controlling the fluid energy admitted thereto. This may be accomplished in one form as shown in FIGS. 2 and 7. A scissors-like arrangement of two valve members 60 and 61 each having fan-like valving portions 62 and 63 of predetermined area are rotatable on a shaft 64 carried on member 55. Each of the members 61 and 62 include central portions 65 and 66, respectively, with the valving portions radiating therefrom. The portions 65 and 66 are partially relieved as indicated in FIG. 2 so that all valve portions 62 and 63 reside in the same plane against valve control member 48.

The members 60 and 61 at portions 62 are pivotally connected at 69 and 70 to links 71 and 72. Links 71 and 72 are pivotally connected to a pin 73 carried on a vertically adjustable block 74. Block 74 is vertically movable on a screw 75 carried by rotatable adjustment member 76 in a housing 77 on member 55. As block 74 is raised by manipulating handle 78, members 60 and 61 are drawn together and when block 74 is lowered members 60 and 61 are spread apart.

The position of the members 60 and 61 determines the magnitude of the fluid energy admitted through ports 48*a* – 48*d*, and hence the power output of the engine.

The control arrangement described is merely illustrative of a means for controlling or throttling the engine to control the power input and hence the output. Block 74 may be moved by the other means such as a hydraulic ram or a lever arrangement, etc.

A cycle of operation will now be considered. As the rotor is in position shown in FIG. 3, it is just reversing its motion and the larger volumes of chambers 27 and 28 are exhausted.

Valve member 42 (FIG. 5) is positioned to close inlets 36*b* and 36*d*, and open inlets 36*a* and 36*c* behind the rotor vanes and admit fluid pressure therebehind. As member 48 moves with rotor 26, projections 45 and 46 ride in grooves 52 and 53 until radial edges thereof engage projections 45 and 46, respectively. Then valve 42 will be moved to close inlets 36*a* and 36*c*, as the exhaust ports 19 and 20 are uncovered by the rotor. The valve member 42 provides a means for timing the openings of the inlet ports 36*a* – 36*d* in accordance with the motion and position of the rotor.

By virtue of spacing between plates 48 and 35, fluid pressure may always pass through ports 48*a* – 48*d* to the open pair of ports 36*a* – 36*d*.

Figure 9:
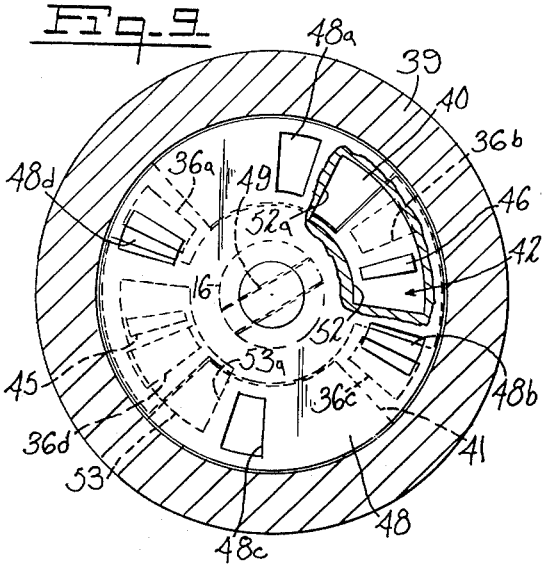
FIGS. 9 – 11 are views similar to FIG. 6 further exemplifying operation of a device embodying the invention.
Figure 10:
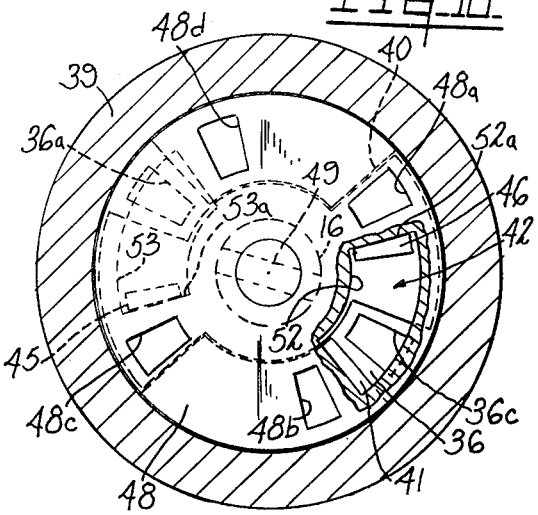
Figure 11:
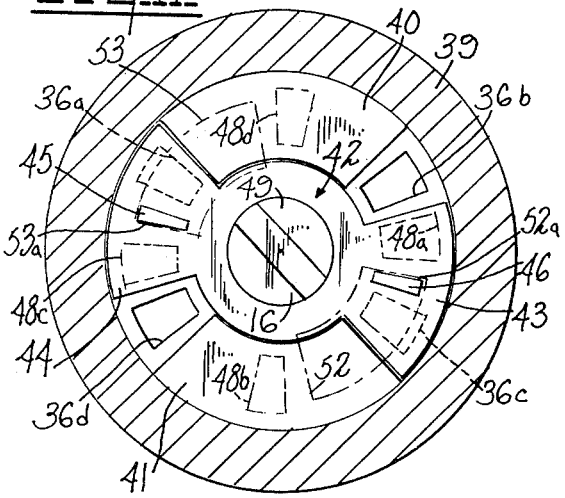

Reference is now made to FIGS. 9 – 11. FIGS. 9 – 11 are similar to FIG. 6 but show different points of a cycle. In FIG. 11, the member 48 is shown in broken line. In FIG. 9, rotor 26 has moved slightly clockwise with respect to FIG. 6, valve 42 closes inlets 36*b* and 36*d* as lugs 45 and 46 ride in grooves 52 and 53. Fluid pressure is being admitted to chambers 27 and 28 through inlets 36*a* and 36*c* to drive rotor 26 clockwise in a first power stroke. As rotation progresses to the point shown in FIG. 10, edges 52*a* and 53*a* of grooves 52 and 53 engage lugs 45 and 46, respectively, to move valve 42, to close inlets 36*a* and 36*c*, and open inlets 36*b* and 36*d*.

As the rotor vanes 32 and 33 pass exhaust ports 19 and 20, the pressure therebehind is relieved and the velocity will start to decrease. As the rotor continues toward the position shown in FIG. 11, the rotor vanes 32 and 33 cover inlets 35*b* and 35*d*. This provides a fluid pressure cushion to arrest and reverse the movement of the rotor as the end of a stroke is approached. As the movement of the rotor reverses inlets 36*b* and 36*d* are uncovered to admit fluid pressure between a rotor vane 32 and 33 and projections 30 and 31 which accelerates the rotor in the opposite direction in a reverse power stroke.

The length of the stroke will be dependent on the pressure and volume of the steam admitted through ports 48*a* – 48*d* by the valving members 60 and 61. The greater the time that ports 48*a* – 48*d* are uncovered by members 60 and 61, the greater the energy input and hence the power output.

Figure 12:
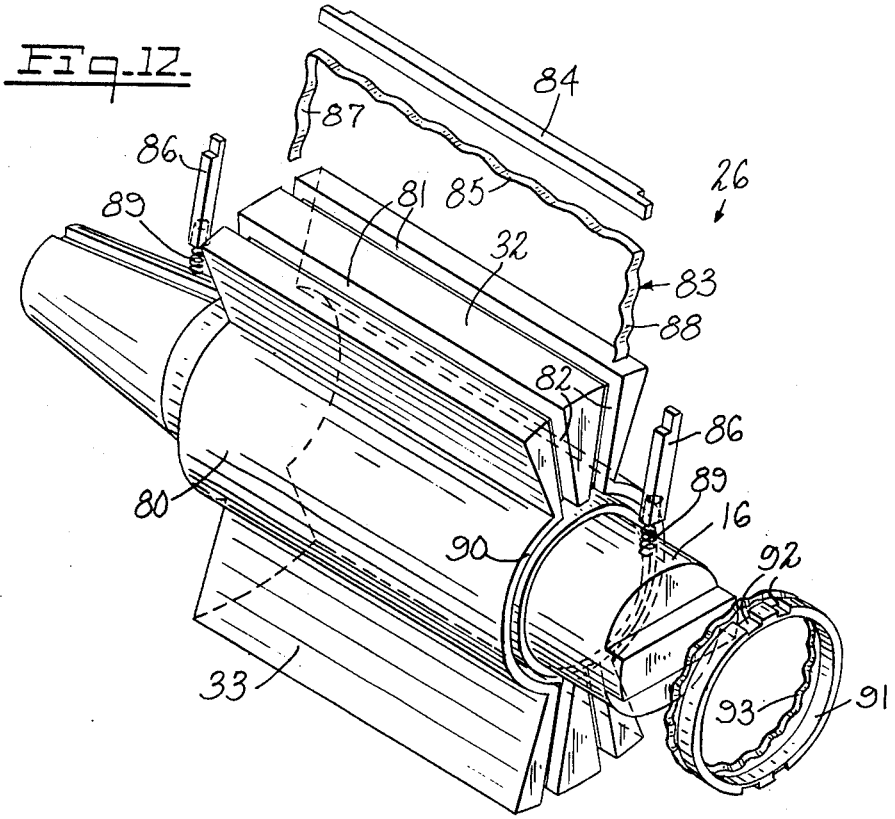
FIG. 12 is a perspective view partially exploded of the rotor of the engine of FIG. 2.

FIG. 12 exemplifies in perspective the construction of rotor 26. The rotor has a hub portion 80 from which the vanes 32 and 33 radially extend. The longitudinal sides of vanes 32 and 33 are defined on a radius from the axis of shaft 16. Each of the vanes have a pair of longitudinal grooves or slots 81 defined therein, and also radial end grooves or slots 82 at either end. A spring member 83 of generally shallow U-shape is received in each groove 81 and the corresponding subtending end grooves 82.

A longitudinal seal member 84 is received in groove 81 over portion 85 of spring 83, and end seal members 86 are received in end grooves 82 over portions 87 and 88 of spring 83, respectively. End seal members have a pocket therein adapted to receive a spring 89, which urges members 86 radially outwardly.

An annular channel 90 is defined in the ends of hub 80 and receive an end seal ring 91 therein. Seats 92 are defined in ring 91 to receive the inner ends of seals 86. A spring 93 is also received in channel 90. Spring 93 acts to bias end seal ring 91 outwardly along shaft 16.

With this arrangement the end seals 86 and 91 are biased against seal 38 and end plate 35, while seals 84 are biased radially outwardly against the inner walls 94 and 95 of housing 15.

The ends of seals 84 and 86 are relieved to overlap as shown, and form a complete seal.

The projections or chambers separators 30 and 31 may be separately formed and attached to the interior of housing 15 as by bolts 96. The inner ends of each of separators 30 and 31 have longitudinal grooves 97 and 98 defined therein which receive seals 99 and 100 of generally L-shape therein, respectively. The seals 99 and 100 are urged toward the hub 80 by springs similar to springs 83, but not shown in FIG. 13. The seals 99 and 100 extend between plates 35 and 38.

The sealing arrangements described provide the advantages of simplicity, efficiency, and self compensation upon wear.

In accordance with the invention, an engine of the oscillating type is arranged to provide a source of unidirectional power by direct coupling to a conversion device. One form of a converter may be a hydraulic pump which delivers fluid under pressure on each power stroke of the engine rotor.

A pump may utilize the same basic rotor-stator structure as the engine for efficient torque to flow conversion.

Figures 14, 15, 16:
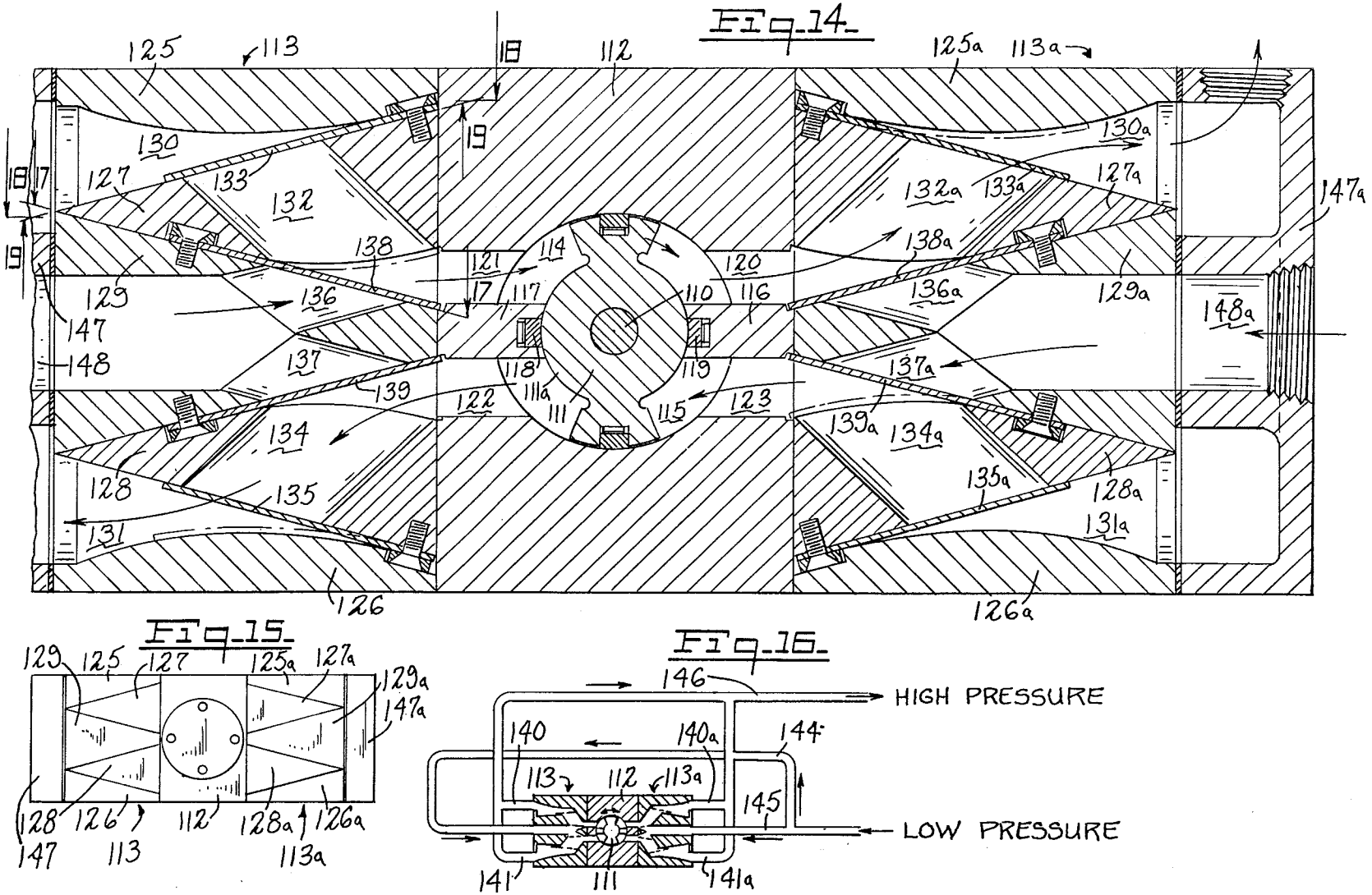
FIG. 14 is a view seen in the plane of lines 14—14 of FIG. 2.
FIG. 15 is a front external view of the pump of FIG. 14.
FIG. 16 is a schematic view similar to FIG. 14 but showing how the pump of FIG. 14 is connected to external piping and conduits.

FIGS. 14 – 16 illustrate the construction and operation of a preferred pump 13. Pump 13 includes a shaft 105 coupled to shaft 16 through coupling member 106 within coupling 14 (FIG. 2). The tapered end 107 of shaft 105 is keyed at 108 to member 106 and the tapered end of shaft 16 is keyed at 109 to member 106. Additionally, a bolt 110 extending through shaft 105 is threaded into the end of shaft portion 109. Shaft 105 and pump rotor 111 thereon will thus follow the motion of shaft 16.

Pump 13 includes a central housing portion 112 and outer valving portions 113 and 113*a*. The outer portions are identical and elements of 113*a* bear the same reference numerals as portion 113 with the letter *a* annexed thereto. The central housing which defines a rotor cavity is divided into chambers 114 and 115 by stator projections 116 and 117. The projections 116 and 117 are provided with seats in their ends receiving seals 118 and 119 therein which contact the hub 111*a* of rotor 111 to define chambers 114 and 115. Communicating with chambers 114 and 115 are ports 120, 121 and 122, 123, respectively.

Each of the valving portions includes a pair of outer valve blocks 125 and 126, a pair of intermediate valve blocks 127 and 128, and a center valve block 129.

Figure 17:
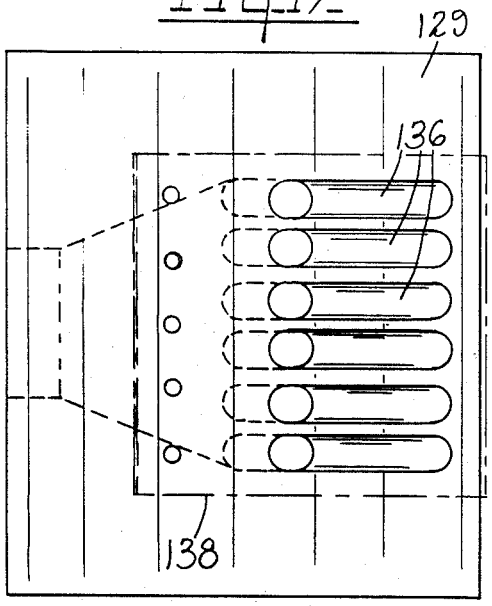
FIG. 17 is a view seen in the plane of lines 17—17 of FIG. 14.
Figure 18:
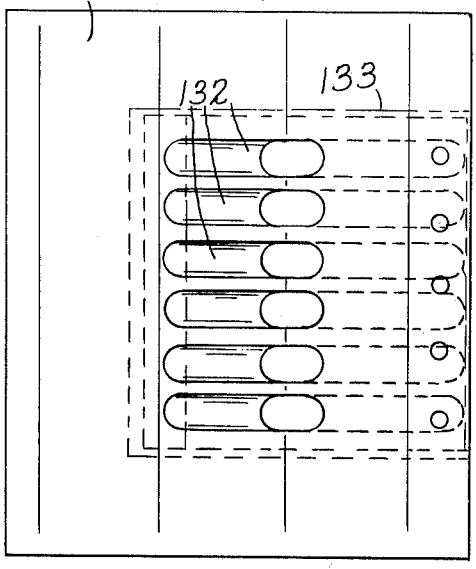
FIG. 18 is a view seen in the plane of lines 18—18 of FIG. 14.
Figure 19:
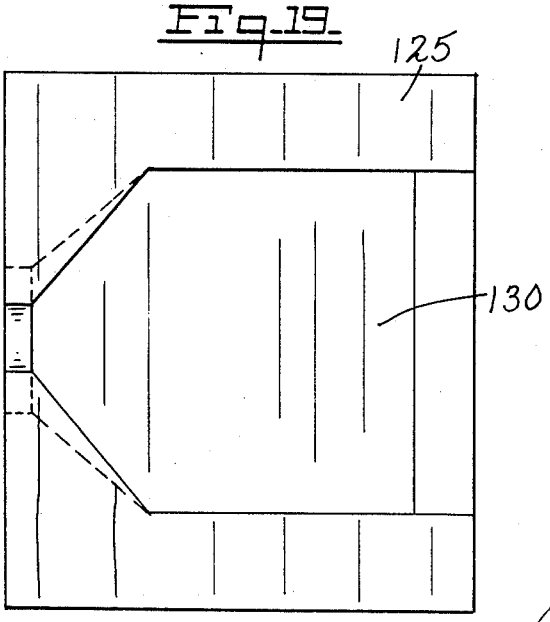
FIG. 19 is a view seen in the plane of lines 19—19 of FIG. 14.
Figure 39:
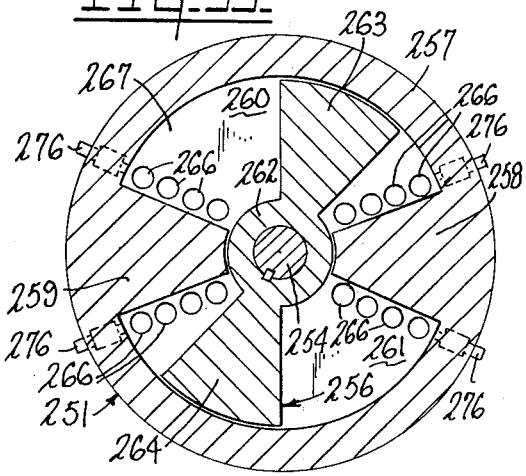
FIG. 39 is a view seen in the plane of lines 39—39 of FIG. 36.
Figure 38:
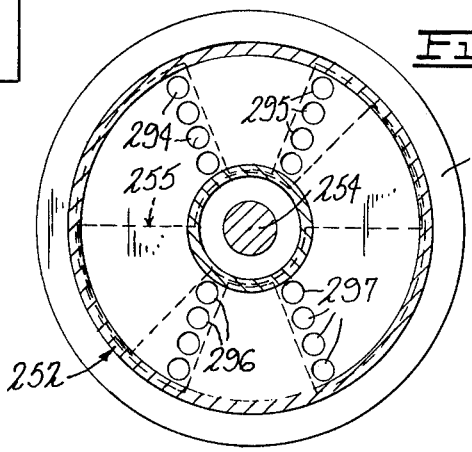
FIG. 38 is a view seen in the plane of lines 38—38 of FIG. 36.

The blocks 125 and 126 define pressure conduits 130 and 131, respectively, as shown in FIG. 19. Block 127 has defined therein a plurality of passages 132 (FIG. 18) which communicate with conduit 130 when a reed-type valve 133 is open. Passages 132 further communicate with port 121. Similarly, block 128 defines a plurality of passages 134 communicating with pump port 122 and with conduit 131 when a reed-type valve 135 is open. Center block 129 defines an intake conduit 135 communicating with each of a plurality of passages 136 (FIG. 17) and passages 137. Passages 136 communicate with pump port 121 when a reed-type valve 138 is open, and passages 137 communicate with pump port 122 when a reed-type valve 139 is open.

When rotor 111 rotates clockwise as shown by the arrow in FIG. 14, pressure is created in chamber 114 in communication with port 120 and fluid will be delivered through passages 132*a* to conduit 130*a* and pressure line 140*a* (FIG. 16). Simultaneously, pressure is created in chamber 115 in communication with port 122 and fluid will be delivered through passages 134 to conduit 131 and pressure line 141 (FIG. 16). During this time the suction sides of pump rotor 111 cause valves 138 and 139*a* to open and draw fluid from the reservoir or return lines 144 and 145.

Upon reverse rotation of rotor 111, intake valves 138*a* and 139 open, and valves 133 and 135*a* open to supply fluid under pressure.

The pump 13 thus continuously supplies fluid under pressure to high pressure line 146. The high pressure conduits on either valving section, for example conduits 130*a* and 131*a* may be connected to a manifold defining member 147*a* which also defines a low pressure inlet 148*a* to inlet conduit 135*a*.

It will be noted that the intake valves 138, 138*a*, 139, 139*a* upon opening will seat to block communication between the pump ports and the adjacent high pressure passages. The valves are secured at one end thereof to the various valve blocks by a plurality of screws, as shown. The valves are resilient reed-like members which inherently reseat when there is no pressure differential thereacross.

Pump 13 converts the oscillatory motion of rotor 16 to unidirectional fluid pressure. This system develops an easily controllable source of fluid energy. The delivered fluid is proportional in flow to engine speed and the pressure is proportional to the torque of rotor 26.

Figure 20:
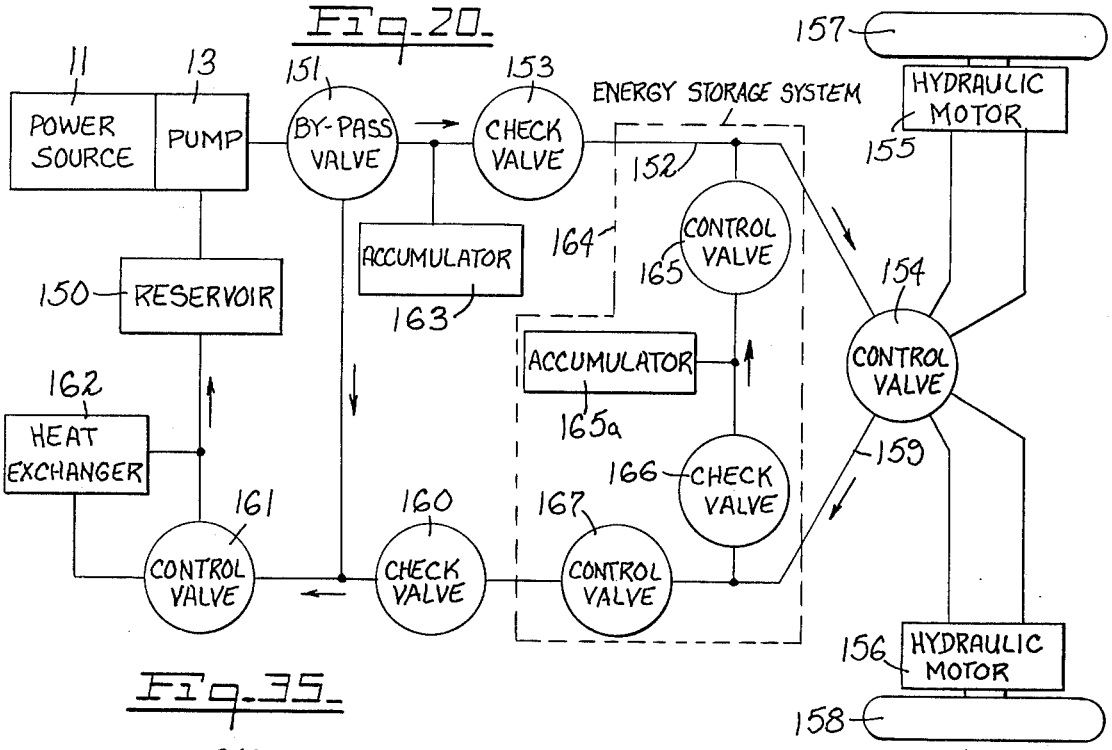
FIG. 20 is a schematic diagram of an automotive system embodying the invention.

The drive system thus far described may be utilized to drive one or more hydraulic motors. It may drive one hydraulic motor which, in turn, drives a drive shaft of a vehicle. Alternatively, it may be utilized to drive hydraulic axle motors in a system as set forth in FIG. 20. Pump 13 driven by engine 11 draws hydraulic fluid from a reservoir 150, and delivers it through a bypass valve 151 to a line 152 including a check valve 153, to a control valve 154 which controls flow to hydraulic motors 155 and 156. Motors 155 and 156 drive the axles of wheels 157 and 158 of a vehicle.

Fluid is returned from the motors through control valve 154, line 159, check valve 160 and a control valve 161 to reservoir 150. Flow may be directed through a heat exchanger 162 by valve 161 to maintain the fluid in a desired temperature range. Valve 161 is a thermostatically controlled valve which operates to control the return of fluid either directly to reservoir 150 or through heat exchanger 162. Valve 151 operates to bypass fluid from the drive system during no-load or idling periods. This valve in essence is a neutral or drive selector. An accumulator 163 may be connected to line 152 to store energy therein and minimize any energy pulsations. The accumulator 163 will generally comprise a pressure cylinder having a piston or bladder therein separating the hydraulic fluid from a gas pressurized by the fluid pressure in line 152.

The control valve 154 determines the direction of rotation of motors 155 and 156. The hydraulic motors 155 and 156 are preferably variable displacement hydraulic motors. The control valve 154 can be eliminated if the hydraulic motors are of the type which include mechanical means to permit change of direction or rotation without changing direction of flow.

This system may also include an energy storage system 164 which is utilized to meet peak demands. The system is charged during braking. A flow control valve 165 controls flow of fluid from accumulator 165*a* when the power source is unable to meet all power demands. This valve is controlled by a throttle or speed control setting. A check valve 166 maintains unidirectional flow, and prevents the accumulator 165 from feeding to low pressure line 159. A control valve 167 restricts flow during braking and accumulator 165*a* then charges through check valve 166. Valve 167 is made responsive to application of brakes, and is a flow control valve.

FIGS. 21 – 24 exemplify another embodiment of an external combustion engine embodying the invention in which the speed and rotor stroke is controlled externally of the engine.

The engine 169 comprises a housing member 170 having a shaft 171 supported therein on a front end plate 172 and a rear bearing, not shown.

Exhaust ports 173 and 174 are defined through housing 170 from the rotor chambers to an exhaust manifold, not shown, surrounding housing 170.

A rotor 175 is mounted to shaft 171 and moves therewith in an oscillating or reversing rotary motion. The rotor cavity is divided into two sections or chambers 176 and 177 by stator projections 178 and 179 of housing 170. The rotor has two vane-like members 175*a* and 175*b* extending diametrically therefrom into chambers 176 and 177, respectively.

The rotor is driven between the stators 178 and 179 by an external source of fluid pressure. The energy applied to the chambers 176 and 177, and the rotor, is controlled by a valving arrangement 180.

The valving arrangement includes stationary valve plates 181 and 182 having openings therein as shown at 181*a* – 181*d*. Corresponding openings are defined in end plate 172. The openings 181*a* – 181*d* are adjacent the extremities of chambers 176 and 177. The openings in each of plates 172 and 181 are aligned and shown slightly angularly shifted in FIG. 21 with respect to the position shown in FIGS. 23 and 24. The openings 181*a* and 181*b* provide communication to upper chamber 176 between the stator projections while the openings 181*c* and 181*d* 181d provide inlets to chamber 177 between the stator projections. These openings into the chambers are positioned near the end of the rotor stroke. A valve member 183 has wing portions 184 and 185. Valve member 183 includes a hub portion 186 having a generally X-shaped slot 187 defined therein to receive key 188 on the end of shaft 171.

Figure 22:
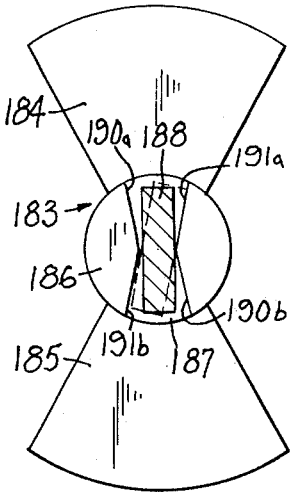
FIG. 22 is a view seen in the plane of lines 22—22 of FIG. 21.
Figure 21:
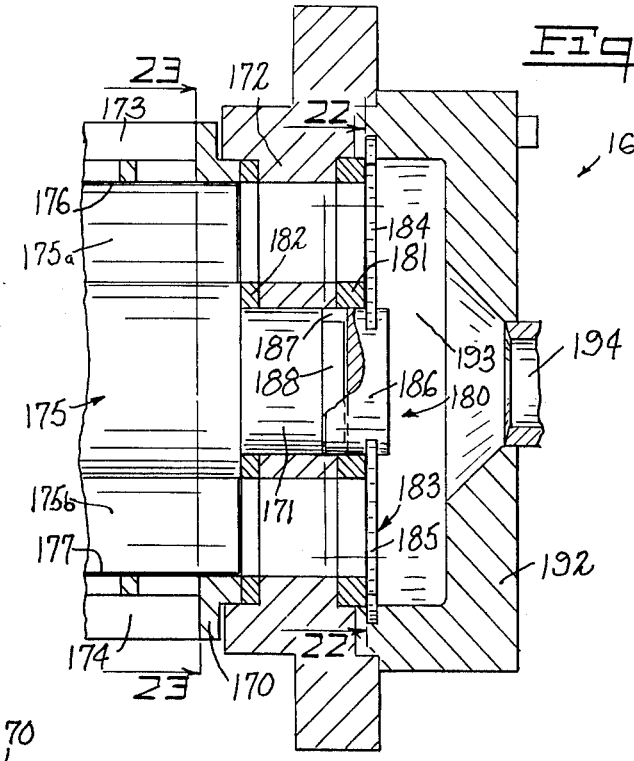
FIG. 21 is a view in partial longitudinal half section of another engine embodying the invention.
Figure 23:
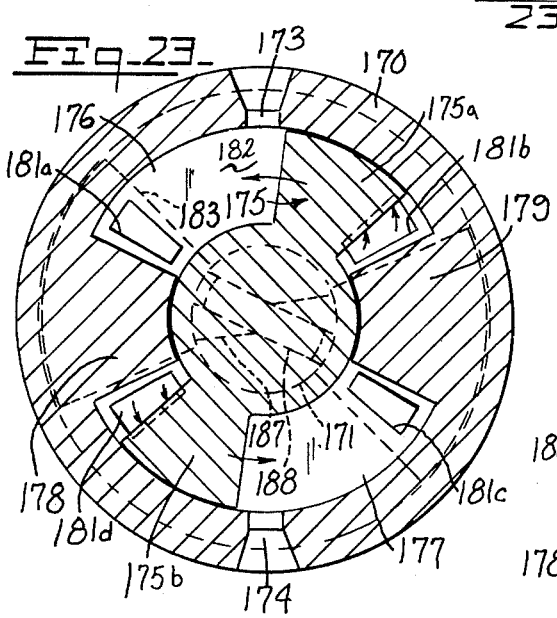
FIG. 23 is a view seen in the plane of lines 23—23 of FIG. 21.

As shown in FIG. 22, key 188 may rotate a predetermined angle without moving valve member 183. This provides a lost motion or timing connection between shaft 171 and valve member 183. The slot 187 has side walls 190*a* and 190*b* which are contacted by key 188 in one direction and side walls 191*a* and 191*b* which are contacted by key 188 in the other direction of rotation. Fluid pressure is applied to end cover 192 defining steam chest 193 through port 194.

Figure 24:
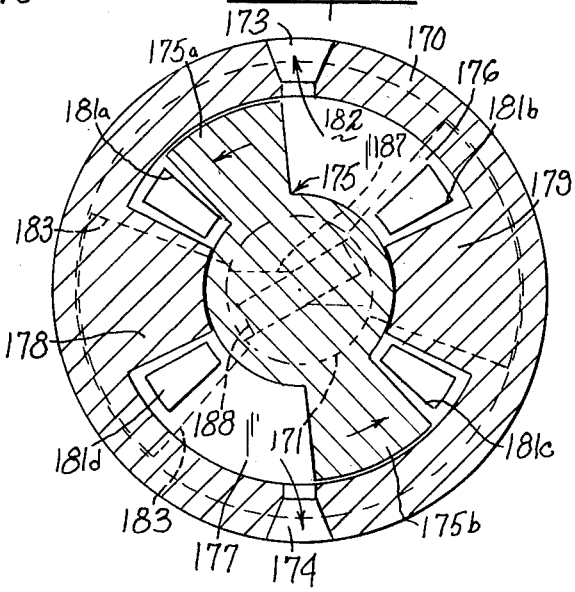
FIG. 24 is a view similar to FIG. 23 at a different operating point of the engine of FIG. 21.

In operation, valve member 183 moves to alternately admit fluid energy to the rotor chambers 176 and 177 and is driven by the rotor shaft 171 through key 188 and the timing connection provided by slot 187. Prior to reaching the position shown in FIG. 23, key 188 has turned valve 183 to close openings 181*a* and 181*c*, and fluid is being admitted to openings 181*b* and 181*d*. This is essentially the point of rotor reversal. The rotor now proceeds to the opposite end of its stroke as shown in FIG. 24. Valve 183 has not moved until the other sides of slot 187 are engaged by key 188. This occurs as the rotor vanes uncover the exhaust ports 173 and 174. This reduces the pressure and force behind the rotor vanes. As the openings 181*a* and 181*c* are uncovered fluid pressure is admitted to the chambers in front of the rotor vanes, as pressure therebehind is relieved, the rotor velocity decreases to zero and then increases in the opposite direction.

In this embodiment rotor stroke and velocity is controlled by controlling the fluid pressure applied to port 194 as hereinafter pointed out.

Figure 25:
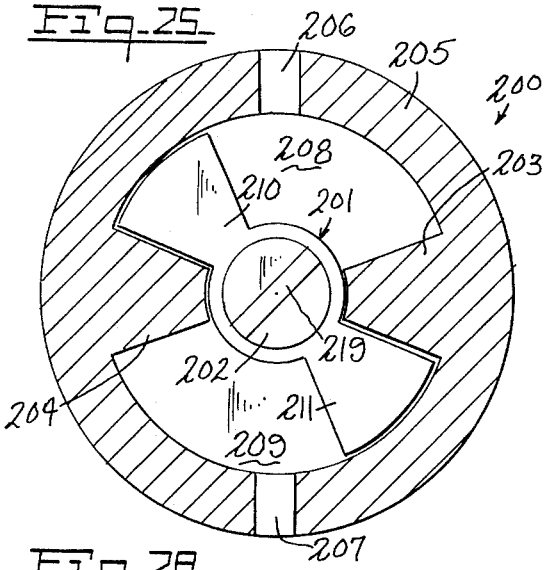
FIG. 25 is a cross-sectional view of another engine embodying the invention.
Figure 26:
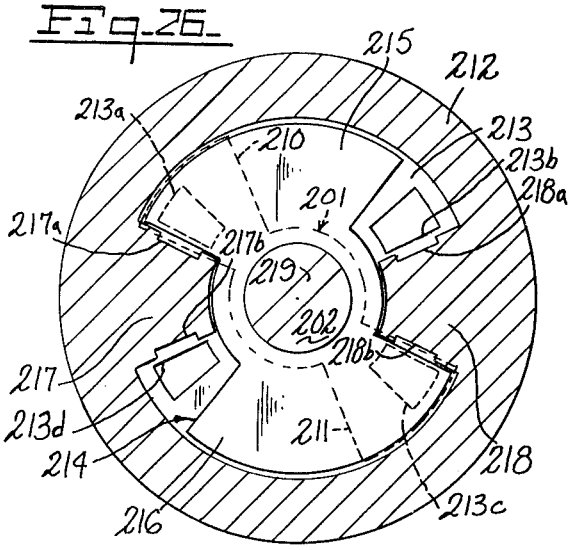
FIG. 26 is a cross-sectional view through a portion of the valving arrangement of the engine of FIG. 25.

Another embodiment of the invention is set forth in FIGS. 25 – 30. In this embodiment the fluid pressure of the source is utilized to shift the valve member to reverse the rotor. FIG. 25 shows a sectional view through an engine 200 having a rotor 201 on a shaft 202 between stator projections 203 and 204 of a housing 205. Exhaust openings 206 and 207 communicate with chambers 208 and 209, respectively. Rotor vanes 210 and 211 extend into chambers 208 and 209.

A valve plate, similar to plate 35 of FIG. 2, not shown, is located at the input end of housing 20. Mounted to the same end of housing 205 is a valve housing member 212, which includes a valve plate 213 disposed therein. Shaft 202 extends through plate 213, and a valve member 214 is rotatable with respect to shaft 202. Inlet openings 213*a* – 213*d* are defined in plate 213, and are selectively covered and uncovered by portion 215 and 216 of valve 214. Member 212 includes valve motion limiting projections 217 and 218 (not continuations of the stator projections 203 and 204). Projections 217 and 218 are relieved to provide recesses 217*a*, 217*b*, 218*a*, and 218*b* therein, which provide communication to the edges of valve portion 215 and 216. These recesses permit fluid pressure to exert a force on the edges of valve member portions 215 and 216 and commence movement thereof between the positions shown in FIGS. 26 and 27. Coupled to the end of shaft 202 by a key 219 is a valve actuating member 220. Member 220 is directly adjacent valve member 214 and limiting projections 217 and 218. The outer surface of members 214, 217, and 218 are in the same plane.

Valve actuating member 220 turns with rotor 202 and has openings 220*a* – 220*d* defined therein in substantially the same angular relationship as openings 213*a* – 213*d* in plate 213.

Figure 28:
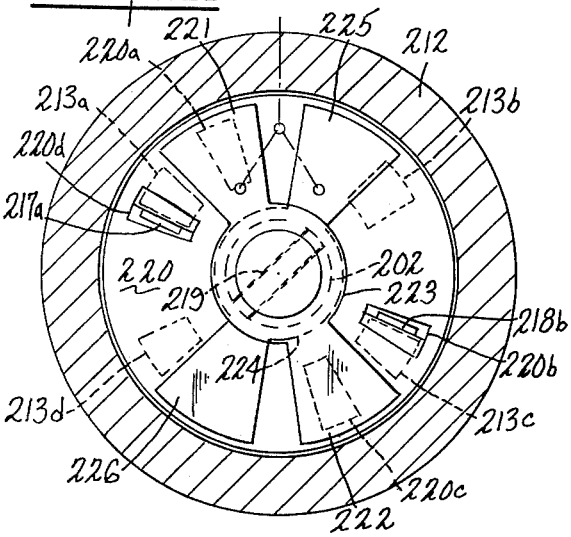
FIG. 28 is a similar view to FIG. 27 but with a speed control element superimposed thereon.
Figure 27:
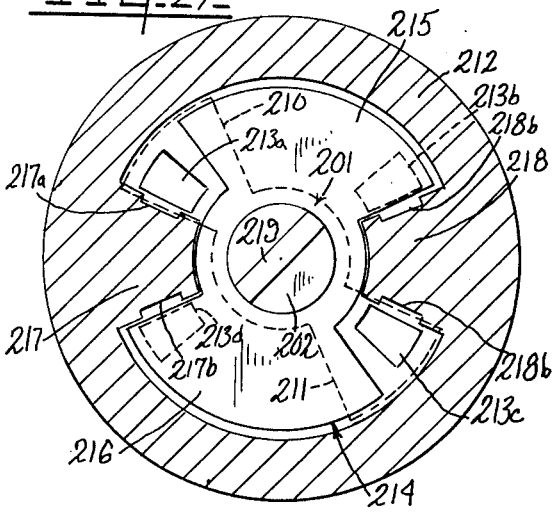
FIG. 27 is a view similar to FIG. 26 with a valve member in a different position.
Figure 29:
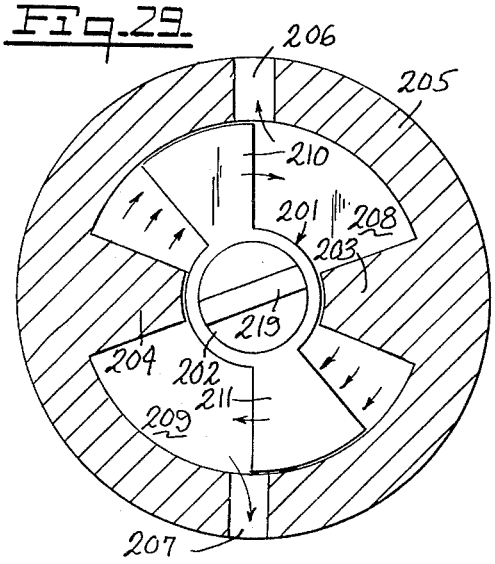
FIG. 29 is a cross-sectional view through the engine of FIG. 25 with the valving elements in the positions shown in FIG. 28.

As shown in FIG. 28, opening 220*d* is in registry with recess 217*a*, and portion 215 of valve 214 is covering opening 212*a*. The fluid pressure on the edge of valve portion 215 through recess 220*d*, and the pressure on the edge of valve portion 216 through recess 218*b* will cause valve 214 to shift to the position shown in FIG. 27. This uncovers opening 213*a* and 213*c* in valve plate 213 and permits the introduction of fluid pressure to chamber 208 on the left of rotor vane 210 and to chamber 209 on the right of rotor vane 211. This produces clockwise rotation of rotor 201, as shown in FIG. 29.

Figure 30:
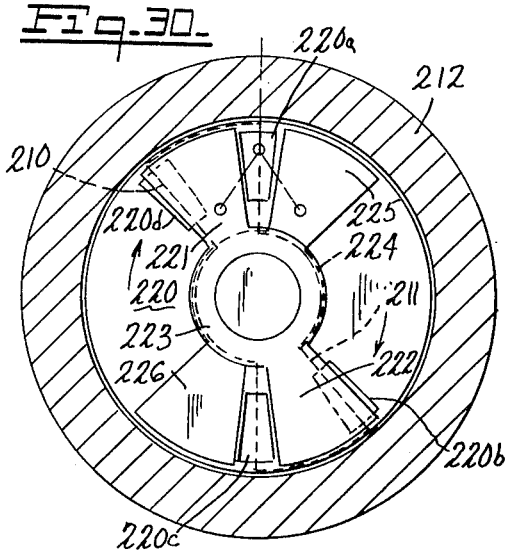
FIG. 30 is a view similar to FIG. 28 but with the rotor of the engine in a clockwise power stroke.

Fluid pressure will continue to be applied as specified through openings 220*d* and 220*b* until openings 220*d* and 220*b* move behind the fan portions 221 and 222 of element 223, as shown in FIG. 30. At this time, the application of fluid pressure is cut-off until the openings in plate 220 communicate with recesses 213*b* and 213*d* near the end of the clockwise stroke as shown in FIG. 29. At this time valve member 214 is shifted back to the position shown in FIG. 26, openings 220*a* and 220*c* will provide communication to opening 213*b* and 213*d*, respectively. This will initially cushion the clockwise stroke of rotor 201 and then reverse its direction and drive it in a counterclockwise power stroke.

The element 223 with portions 221 and 222, as well as complimentary element 224 with portions 225 and 226, act as speed control elements to control the time in which openings 220*a* – 220*d* in plate 220 are uncovered. This controls the energy applied to the rotor as well as the time of energy application. This further determines the length of the power strokes of rotor 201.

Control of the elements 223 and 224 as schematically illustrated in FIGS. 28 and 30 may be the same as the elements 60 and 61 of FIGS. 2 and 7. As the elements 223 and 224 are spaced apart from the position shown in FIGS. 28 and 30, the time of application of fluid energy to the chambers 208 and 209 is decreased.

Figure 13:
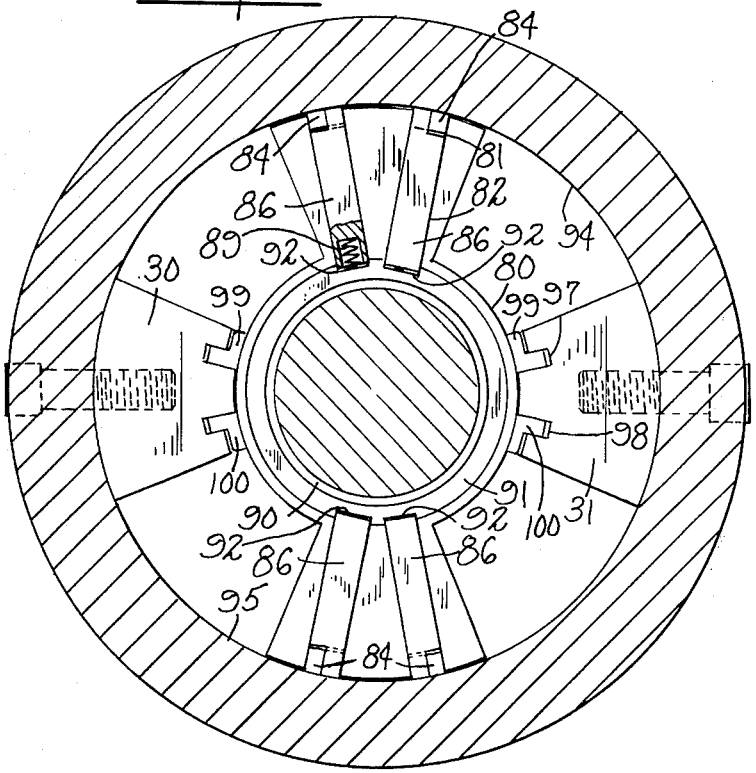
FIG. 13 is a view seen in the plane of lines 13—13 of FIG. 2.

In the embodiment of FIGS. 21 – 24 and also FIGS. 25 – 30, the rotor housing and end plate arrangements as well as the rotor and stator seals are the same type as shown in FIGS. 2, 12, and 13.

In all of these arrangements, the time of selective timing of the application of fluid pressure to the chambers and reversal of the rotor is determined by the position of the rotor shaft. This insures proper timing regardless of rotor speed or length of stroke.

Figure 31:
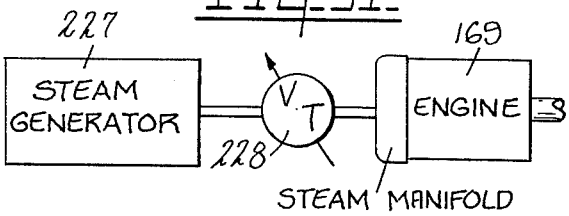
FIG. 31 is a simplified view of an external combustion engine including a steam generator.

FIG. 31 exemplifies a typical arrangement of an external combustion engine 169 embodying the invention. The engine shown in FIGS. 21 – 24, receives fluid energy in the form of steam from a steam generator 227 of any suitable type through a throttling valve 228. Valve 228 determines the amount of energy applied to engine 169 and hence the speed and rotor stroke thereof.

FIGS. 32 – 36 exemplify an internal combustion engine 230 embodying the invention. Engine 230 is shown as being of the spark ignition type. However, it could also be of the diesel type. The engine comprises a housing 231 having stator projections 232 and 233 defining a combustion chamber 234 and a precompression chamber 235. A rotor 236 has a hub portion 237 and diametrically extending vanes 238 and 239. Hub 237 has a plurality of ports 240 and 241 defined in either side thereof to provide passages for precompressed air from chamber 235 to 234, as hereinafter more fully described. Air inlets 242 and 243 are defined in housing 231 in communication with chamber 234, and an exhaust port 244 is defined in housing 231 between projections 232 and 233.

Spark plugs 246 and 247 are positioned at either end of chamber 234. The outer extremity of vane 239 has a dimension such that it may be positioned between inlet ports 242 and 243. The rotor and stator projections may carry sealing means as previously described in conjunction with FIGS. 12 and 13.

Figure 32:
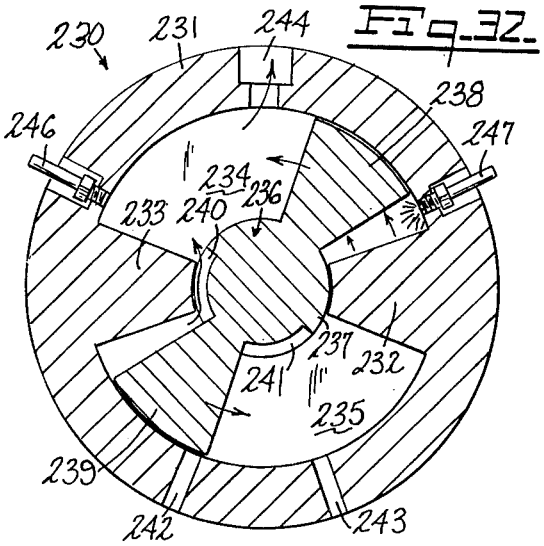
FIGS. 32, 33 and 34 are sectional views taken perpendicular to the axis of rotation of an internal combustion engine embodying the invention.

In operation, as rotor vane 238 has neared projection 232 (FIG. 32), spark plug 247 fires and rotor 236 commences to move in a couterclockwise direction, as indicated by the arrows, in a power stroke. The products of combustion from the previous power stroke are exhausted through port 244 as rotor 236 is in the position shown in FIG. 33. The fuel-air mixture which was drawn into chamber 235 as rotor 236 moved clockwise to the position shown in FIG. 32 is compressed between rotor vane 239 and projection 232 until the rotor turns to a position where ports 241 provide communication from chamber 235 to chamber 234. The new fuel-air mixture serves to purge chamber 234, behind vane 238, of the products of combustion. As rotor 236 moves to the position shown in FIG. 33, the fuel-air mixture adjacent projection 233 is compressed. When spark plug 246 fires, the rotor reverses direction as shown in FIG. 34. As the rotor moves clockwise, the mixture previously drawn in through port 242 is compressed by rotor vane 239, and subsequently moves through ports 240 to chamber 234.

The compression ratio of this engine will vary in accordance with the energy expended behind the vanes in the combustion chamber. As the vanes in the combustion chamber near the end of a stroke, the compressed mixture in front of the vane will act to cushion, slow, and stop the stroke prior to the next power stroke.

The spark plugs may be fired through the use of timing cams closing contacts in accordance with shaft position, in a conventional manner.

While the engine illustrated in FIGS. 32 – 35 is of the spark ignition type, it will be understood in a similar configuration, injection nozzles may be provided for diesel operation.

Figure 33:
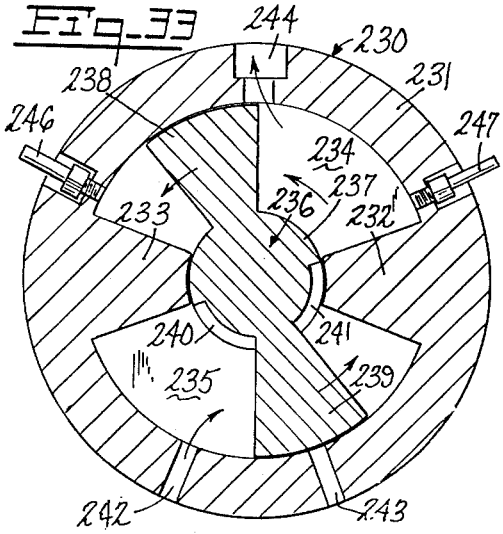
Figure 34:
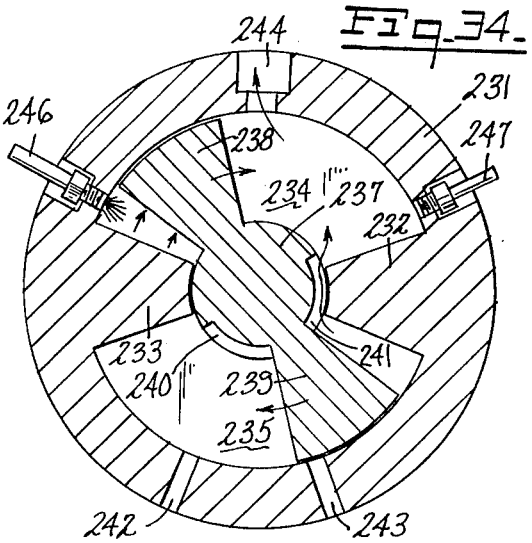
Figure 35:
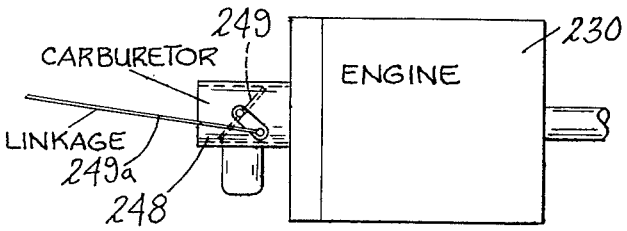
FIG. 35 is a side view of an internal combustion engine embodying the invention showing a carburetor thereon.

The engine 230 of FIGS. 32 – 34 will require a carburetor 248, as shown in FIG. 35. Such carburetor will be of a conventional type having a throttle valve 249, controlled by a linkage 249*a* to control engine speed. The stroke and, hence, the compression ratio will increase with engine speed. Check valves or other one-way valves, not shown, will control opening of the intake ports 242 and 243.

The invention may also be embodied in an internal combustion engine including a separate precompressor stage. Such an engine of the diesel type is shown in FIGS. 36 – 41.

An engine 250 comprises a combustion section 251, an intercooler 252 and a precompression section 253. A shaft 254 has a first rotor 255 thereon in compression section 253 and a second rotor 256 thereon in combustion section 251. Combustion section 251 comprises a housing 257 having stator projections 258 and 259 defining chambers 260 and 261. Rotor 256 has a hub portion 262 keyed to shaft 254 between projections 258 and 259. Vanes 263 and 264 extend from hub 262 into chambers 260 and 261, respectively. The vanes may carry the same seals as the external combustion engine as previously described. Hub 262 and the ends of projections 258 and 259 are also similarly sealed.

A plurality of inlet ports 266 (FIG. 39) are defined in end wall 267 of combustion portion 251, communicating with intercooler 252. A plurality of exhaust ports 268 are defined in end wall 269 (FIG. 40). Check valves, not shown, permit air to enter combustion portion 251 from intercooler 252 which block reverse communication. Shaft 254 drives a pump 13, as previously described.

Positioned on either side of chambers 260 and 261 are fuel injection nozzles 270, 271; and 272, 273, respectively. Also positioned on either end of both chambers are glow or igniter plugs 276.

Supercharger or precompressor 253 has an inlet end housing 280 with openings 281 defined therein in a line essentially perpendicular to the line of openings 268. The rotor 255 of supercharger 253 has a hub 285 keyed to shaft 254 and vanes 286 and 287 extending therefrom into chambers 288 and 290, respectively. The chambers 288 and 290 are defined within the housing 291 by housing projections 292 and 293. The combustion chamber rotor and the supercharger rotor are disposed essentially 90° apart on shaft 254.

The air compressed in supercharger 253 is forced into intercooler 252 through rows of ports 294, 295, 296 and 297 in end wall 298 of supercharger 253. These ports will include one-way valves, not shown, to permit the air to move only from supercharger 253 to intercooler 252.

In operation, assume that supercharger rotor 255 is moving in the clockwise direction as shown in FIG. 37. As the ports 281 are closed off air will be compressed ahead of vanes 286 and 287. Then, when the pressure has increased to a predetermined value, the valves in ports 294–297 in end wall 298 open to pass the compressed air into intercooler 252. Air from intercooler 252 will further be compressed in chamber 260 as the rotor continues to rotate (counterclockwise as viewed in FIG. 39). As engine rotor vanes 263 and 264 move toward projections 258 and 259, respectively, the air is highly compressed. Upon injection of fuel through nozzles 271 and 272, combustion will occur and the rotor will reverse. On the reverse stroke, the chambers will be exhausted as ports 268 are uncovered. As the vanes 263 and 264 move toward projections 259 and 258, respectively, air is compressed slowing up the rotor. Then fuel is injected by nozzles 270 and 273, combustion occurs and the rotor again reverses.

The intercooler, which serves as a manifold, may be omitted if a differential is placed between the combustion chamber rotor shaft and the precompressor rotor shaft. Then the two shafts would rotate in phase but in opposite directions and the compressed air would be introduced directly into the combustion chambers from the compressor chambers.

A fuel injection system 310 for the engine of FIG. 36 is shown in FIG. 41. A housing 311 defines chambers 312 and 313 and smaller diameter extensions 312*a* and 313*a* thereof. Free pistons 314 and 315 with smaller diameter extensions 314*a* and 315*a* are movable in chambers 312, 312*a* and 313, 313*a*, respectively. A fuel line 316 leads to parallel injection passages 317 and 318. Passages 317 and 318 communicate with chambers 313*a* and 312*a*, respectively. Each of passages 317 and 318 include a check valve 319 and 319*a*, respectively. Fuel line 316 leads from a fuel pump, not shown. A channel 320 provides fluid communication between chambers 312 and 313. Line 322 leading to chamber 312 is connected to pump lines 140 and 141*a* of pump 13 (FIG. 16) and line 323 leading to chamber 312 is connected to pump lines 140*a* and 141. Lines 317 and 318 each include an injector valve 324 and 325, respectively, which control the fuel flow to injector nozzles 270–273, and hence engine speed. The valves may be incorporated into one housing for simultaneous operation. Fuel through valve 324 is applied to nozzles 270 and 273. Fuel through valve 325 is applied to injection nozzles 271 and 273.

In operation, the pistons 314 and 315 reciprocate at a speed determined by the pressure cycles of pump 13 and hence the speed of engine 250. As piston 314 moves in the direction of the arrow due to pressure from pump 13 through line 323, pressure is applied to the fuel in portion 312*a* of chamber 312. When the pressure is sufficient injection nozzles 271 and 273 open and inject fuel. As this occurs, the pressure in line 322 has fallen off, and piston 315 moves to the left, as shown in FIG. 41, due to the communication provided by channel 320. This increases the volume of the chamber portion and permits a charge of fuel to enter through check valve 319. On the reverse cycle of pump 13 piston 315 will move to the right as shown in FIG. 41 to deliver fuel through valve 324 to nozzles 270 and 273. The injector pump will thus operate at a speed determined by the speed of the engine 250 and will deliver volumes of fuel determined by the travel of pistons 314 and 315 and the setting of valves 324 and 325.

It will be apparent that a spark ignition internal combustion engine may be configured in the same manner as shown in FIG. 36.

The internal combustion engines constructed in accordance with the invention have a high torque and horsepower output per unit weight and volume. An engine weighing one hundred pounds with an overall volume of one cubic foot will deliver over one hundred horsepower. Full torque and speed may be achieved on the second power stroke.

An engine of similar dimension will deliver over two hundred horsepower as a steam driven external combustion engine. An engine has been successfully operated with an input of steam at 900° F and a pressure of 900 pounds per square inch.

Extremely high compression ratios are obtained. This is particularly beneficial in the external combustion engines. The high compression ratios keep the housing at high temperature, and the incoming steam loses little energy in the form of heat to the housing.

Figure 42:
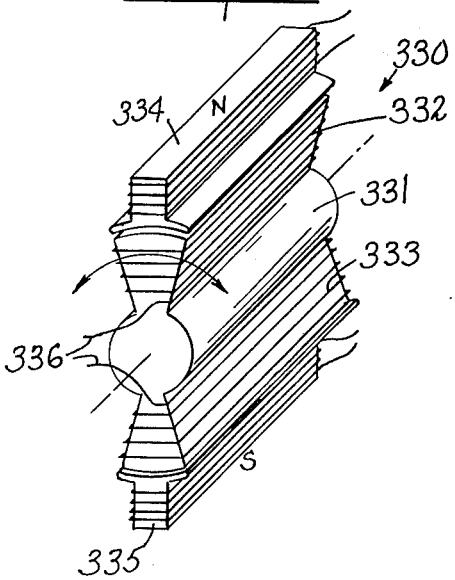
FIG. 42 is a perspective view of an electrical generator which may be coupled to any of the oscillating rotor engines described above.

The oscillating motion of the engine shaft may be converted to more usable unidirectional energy hydraulically as previously described, or electrically as exemplified in FIG. 42.

A generator 330 having a rotor 331 with windings 332 and 333 on opposite poles thereof is connected to the shaft on one of the engines described, and oscillates between electromagnetic pole pieces 334 and 335. An alternating voltage is picked up at rotor leads 336. The power output may be converted to direct current, regulated in a conventional manner, and utilized to drive one or more motors.

Any of the disclosed engines may be utilized to drive a pump as described or an electrical generator, or other type of converter which will convert the oscillating motion of the engine to a more usable motion or energy form.

While the various engines shown all have two chambers and a two vaned rotor, it will be understood that an engine could be constructed with but one chamber, and one rotor vane. Also, the engines may be configured with three or more chambers and corresponding rotor vanes. In the external combustion configuration, the stationary valve plate, valving member, and valve control member would be configured in accordance with the number of chambers. In the internal combustion configurations, a precompressor or supercharger may be incorporated in the engine as shown in FIGS. 32 – 35 or may be separate from the combustion chamber housing.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention

What is claimed is:

1. A drive system comprising an engine of the type having a housing, a rotor reversely rotatable between two extremities in said housing where the rotor has at least one radial vane extending into at least one chamber defined by said extremities, means for varying the magnitude of the angular strokes and the speed of said rotor, and an energy conversion device coupled to said rotor to convert the oscillatory mechanical energy of said rotor to unidirectional energy of another form.

2. The drive system of claim 1 wherein said conversion device is a pump adapted to convert oscillating motion of said engine into hydraulic fluid pressure.

3. The drive system of claim 2 further including a pair of hydraulic motors, each adapted to power a wheel of a vehicle, a fluid reservoir, said pump drawing hydraulic fluid from said reservoir and supplying hydraulic fluid under pressure to said motors, and a return line from said motors to said reservoir.

4. The system of claim 1 wherein said engine is of the external combustion type, a source of fluid pressure. and means for applying fluid pressure from said source selectively to said at least one chamber, said means for varying including valving means for regulating the fluid pressure energy applied to said chambers.

5. The system of claim 4 further including means for controlling the time during each stroke when fluid is applied to said chamber.

6. The system of claim 1 wherein said conversion device is an electrical generator.

7. The drive system of claim 1 wherein said conversion device is a pump, said pump comprising housing means defining a rotor cavity, stator projections defining two chambers in said cavity, a rotor having a hub portion rotatably mounted between said projections and vanes extending into each of said chambers, a port communicating with opposite sides of each of said chambers, an inlet conduit communicating with a pair of said ports on each side of said rotor, an outlet conduit communicating with each of said ports, valving means in said conduits each responsive to pressure differentials in one direction thereacross to selectively connect said inlet conduits and said outlet conduits to said ports whereby as said rotor is driven in oscillatory motion fluid is drawn through said inlet conduits and predetermined ports into said chamber behind the direction of rotation of said rotor vanes, and expelled from the chambers in front of the direction of motion of said vanes into predetermined ports and outlet conduits.

8. The drive system of claim 4 wherein said valving assembly comprises a fixed valve plate at one end of said housing, first and second pairs of openings in said valve plate, each pair communicating with one of said chambers adjacent the extremities thereof, a rotor shaft extending through said valve plate, a valve member adapted to be shifted in position to alternately open and close one of each pair of said openings to provide communication to said chambers on opposite sides of said rotor, and means on said rotor shaft for shifting said valve member as said rotor approaches the end of a stroke.

9. A drive system comprising an engine of the type having a housing, a rotor reversely rotatable between two stator members in said housing where the rotor has diametrical vanes extending into chambers defined by said stator members, a valving assembly, means for selectively applying fluid pressure to said chambers through said valving assembly to cause said rotor to oscillate, an energy conversion device coupled to said rotor to convert the oscillatory mechanical energy of said rotor to unidirectional energy of another form, said conversion device having a rotor element which follows the motion of said engine rotor.

10. A drive system of claim 9 wherein said conversion device is a pump adapted to convert oscillating motion of said engine into hydraulic fluid energy.

11. The drive system of claim 10 further including a pair of hydraulic motors, each adapted to power a wheel of a vehicle, a fluid reservoir, said pump drawing hydraulic fluid from said reservoir and supplying hydraulic fluid under pressure to said motors, and a return line from said motors to said reservoir.

12. The system of claim 9 further including means for controlling the magnitude of the fluid applied to said chamber during each stroke of the rotor.

13. The system of claim 9 further including means for controlling the time during each stroke when fluid is applied to said chambers.

14. The system of claim 9 wherein said conversion device is an electrical generator.

15. The drive system of claim 9 wherein said conversion device is a pump, said pump comprising housing means defining a rotor cavity, stator projections defining two chambers in said cavity, a rotor having a hub portion rotatably mounted between said projections and vanes extending into each of said chambers, a port communicating with opposite sides of each of said chambers, an inlet conduit communicating with a pair of said ports on each side of said rotor, an outlet conduit communicating with each of said ports, valving means in said conduits each responsive to pressure differentials in one direction thereacross to selectively connect said inlet conduits and said outlet conduits to said ports whereby as said rotor is driven in oscillatory motion fluid is drawn through said inlet conduits and predetermined ports into said chamber behind the direction of rotation of said rotor vanes, and expelled from the chambers in front of the direction of motion of said vanes into predetermined ports and outlet conduits.

16. The drive system of claim 9 wherein said valving assembly comprises a fixed valve plate at one end of said housing, first and second pairs of openings in said valve plate, each pair communicating with one of said chambers adjacent the extremities thereof, a rotor shaft extending through said valve plate, a valve member adapted to be shifted in position to alternately open and close one of each pair of said openings to provide communication to said chambers on opposite sides of said rotor, and means on said rotor shaft for shifting said valve member as said rotor approaches the end of a stroke.

17. The drive system of claim 1 wherein said engine is of the internal combustion type.

18. A drive system comprising an internal combustion engine of the type having a housing, a rotor reversibly rotatable between two stator members in said housing where the rotor has a vane extending into the chamber defined by said stator members, means for delivering fuel to said chamber on either side of the vane therein adjacent said stator members, an exhaust port defined from the chamber between said stator members, means for controlling the fuel delivered to said chambers to control the angular stroke and speed of said rotor, and an energy conversion device coupled to said rotor to convert the oscillatory mechanical energy of said rotor to unidirectional energy of another form, said conversion device having a rotor element which follows the motion of said engine rotor.

19. The engine of claim 18 wherein two chambers are defined in said housing by stator projections and said rotor has vanes extending into each of said chambers, said rotor being positioned between said projections, said projections defining extremities for both chambers, one of said chambers providing a combustion chamber and the other of said chambers providing a precompression chamber, said housing defining a pair of air inlet ports in said precompression chamber, passages defined in said rotor on either side thereof such that when said rotor vanes approach an extremity, said passages provide communication from said precompression chamber ahead of the direction of motion of the vane therein to said combustion chamber behind the vane therein in the direction of motion of the vane.

20. The drive system of claim 19 wherein said inlet ports are positioned in said housing such that as the vane in the precompression chamber is compressing air on one side thereof, it is drawing air into the precompression chamber on the other side thereof.

21. The drive system of claim 18 further including spark ignition devices positioned in said housing adjacent said extremities.

22. The drive system of claim 18 wherein said means for delivering fuel comprise fuel injectors.

23. A drive system comprising an internal combustion engine having a housing member defining a first chamber having angular extremities, first and second coupled rotors in said first and second chambers, respectively, adapted to have reversing rotative motion, each having first and second vanes thereon, said first housing chamber being a combustion chamber, said second housing chamber and rotor defining a precompressor, inlet openings into said second chamber arranged to draw air into said second chamber behind the direction of rotation of said second chamber vane whereby the air drawn in said second chamber is compressed in front of the direction of rotation of said second chamber vane, means for delivering fuel to said second chamber adjacent said extremities in front of the direction of rotation of said vanes, means providing one-way fluid communication from said second chamber to said first chamber, said communication providing means adapted to transmit compressed air from said second chamber to said first chamber in front of the direction of rotation of said first vane, means for controlling the fuel delivered to said second chamber to control the speed and angular stroke of said rotors, and an energy conversion device coupled to said rotors to convert the oscillatory mechanical energy of said rotors to unidirectional energy of another form.

24. The drive system of claim 23 wherein said fuel delivering means comprise fuel injectors positioned adjacent said extremities.

25. The drive system of claim 22 further including spark fuel igniters positioned adjacent said extremities.

26. The drive system of claim 23 where said conversion device includes a rotor which follows the motion of said engine combustion chamber rotor.

* * * * *